US005865037A

United States Patent [19]

Bostic

[11] Patent Number: 5,865,037

[45] Date of Patent: Feb. 2, 1999

[54] INSULATED CHEST AND METHOD

[75] Inventor: William M. Bostic, Asheboro, N.C.

[73] Assignee: Vesture Corporation, Asheboro, N.C.

[21] Appl. No.: 705,753

[22] Filed: Aug. 30, 1996

[51] Int. Cl.[6] ..... F25D 3/08

[52] U.S. Cl. ..... 62/371; 62/457.2; 62/457.7; 62/440; 220/361; 220/367.1; 220/420

[58] Field of Search ..... 62/3.71, 457.1, 62/457.2, 457.7, 457.9, 440; 220/420, 425, 469, 361, 367.1

[56] References Cited

U.S. PATENT DOCUMENTS

| | | | |
|---|---|---|---|
| 1,318,547 | 10/1919 | Edmundson | 220/425 |
| 1,541,945 | 6/1925 | Hamilton | 220/425 |
| 2,199,301 | 4/1940 | Bonnefoy | 62/389 |
| 2,329,765 | 9/1943 | Jackson et al. | 220/425 |
| 3,885,403 | 5/1975 | Spencer | 62/530 |
| 4,920,964 | 5/1990 | Francis, Jr. | 128/403 |
| 5,150,707 | 9/1992 | Anderson | 128/402 |

*Primary Examiner*—John M. Sollecito

[57] ABSTRACT

A lightweight, insulated chest and method are provided for transportation and storage of perishable and other items which require a temperature-controlled environment. The chest includes insulated side walls, bottom and a hinged cover which is pneumatically sealed to prevent tampering and for thermal security. The chest includes a fluid conduit within the cover for air evacuation and depressurization of the interior and also includes a conduit to provide a vacuum between the walls of the sides and bottom which contain a rigid polymeric foam insulation.

21 Claims, 3 Drawing Sheets

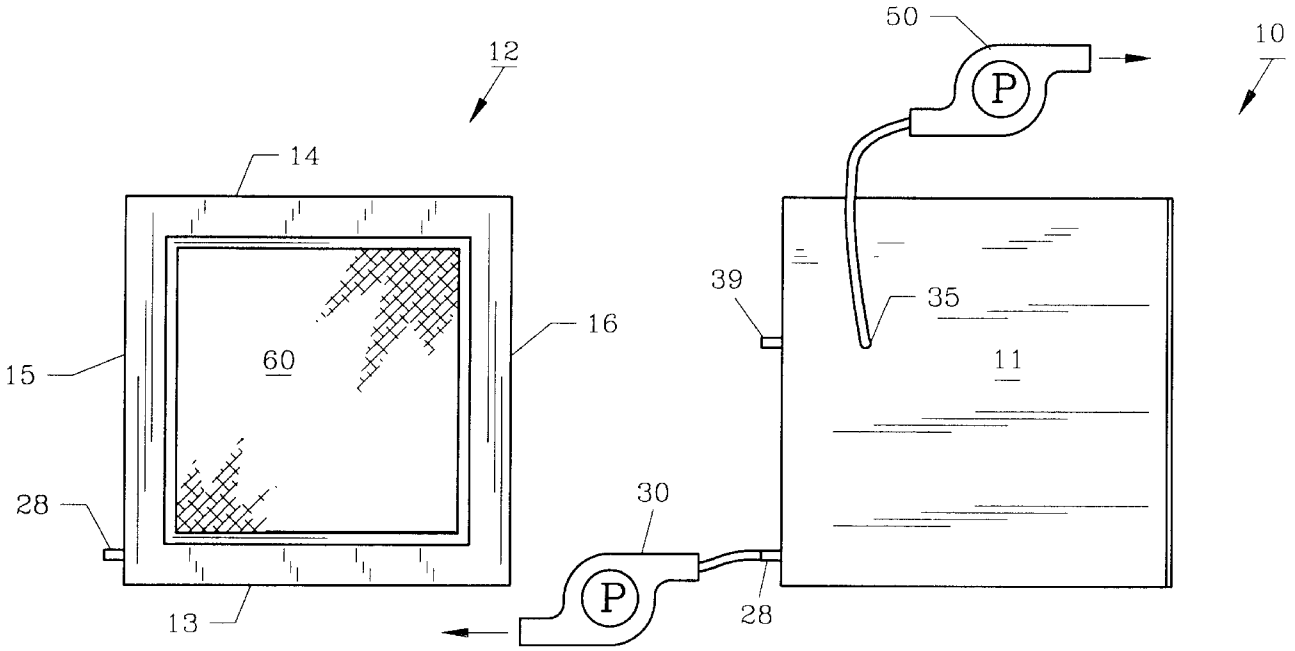
FIG. 4
FIG. 3
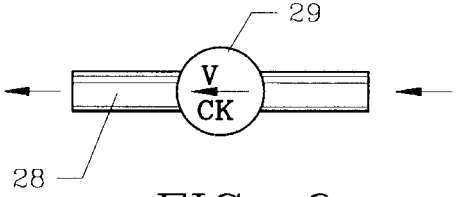
FIG. 6
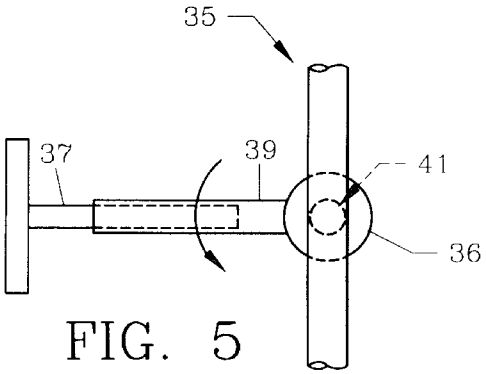
FIG. 5

INSULATED CHEST AND METHOD

BACKGROUND OF THE INVENTION

1. Field of the Invention

The invention herein pertains to an insulated storage chest and particularly to a chest used to store and transport perishable items such as certain foods, biological materials and the like.

2. Description of the Prior Art And Objectives Of The Invention

Insulated storage chests have been used for many years to transport food and other items in a temperature-controlled environment. Such chests generally employ insulated walls between which a heating or cooling device is placed proximate the food items. Such chests are useful and reliable for relatively short periods of time (2–4 hours). However, if perishable items are to be kept longer at specific temperatures, then often the perishable items have to be removed and the heating or cooling devices replaced or re-energized at periodic intervals to maintain the interior of the chest at the desired temperature. Such exchanges of the heating or cooling devices are oftentimes difficult, if not impossible, especially if the chest is being transported, for example, in an airplane where access to the chest is not available. Also, in remote field locations, re-energizing or replacing of the heating or cooling device may not be practical.

Thus, with the disadvantages and problems associated with prior art insulated chests, the present invention was conceived and one of its objectives is to provide a portable, relatively lightweight storage chest for perishable items which will maintain a controlled and desired temperature level in excess of twenty-four hours under normal ambient temperatures.

It is still another objective of the present invention to provide an insulated chest and method which will greatly facilitate the storage and transportation of foods, biological materials and other items which require temperature control.

It is yet another objective of the present invention to provide an insulated chest which is pneumatically sealed for thermal security.

It is a further objective of the present invention to provide an insulated chest which will prevent convective and conducted heat transfer to the exterior thereof.

It is still a further objective of the present invention to provide an insulated chest which incorporates a conduit within a hinged cover which can be connected to a vacuum pump for sealing the chest and evacuating the air from around its contents.

It is also an objective of the present invention to provide an insulated chest in which the side walls and bottom have both an insulating material therebetween and are vacuum processed to increase the insulation rating.

Various other objectives and advantages of the present invention will become apparent to those skilled in the art as a more detailed description is set forth below.

SUMMARY OF THE INVENTION

The aforesaid and other objectives are realized by the insulated chest and method as described herein for storing and transporting perishable or other items which require strict temperature control. The chest is formed from plastic whereby relatively thick sides, bottom and a cover contain a rigid, polymeric foam for insulation purposes. The side walls and bottom are evacuated at the factory by an electric vacuum pump to increase the insulative qualities. In use, perishable items are placed within the chest with a heating or cooling device as needed proximate the perishable items. The hinged cover is then closed and a vacuum pump is attached to a valved conduit on the cover and a vacuum is drawn on the interior of the chest which both seals the cover and improves the thermal security of the contents. Once a sufficient vacuum has been drawn a wrench is inserted into a channel to turn a ball valve to a closed position. The wrench is removed, the vacuum pump is disconnected and the sealed chest is ready for storage and transportation.

BRIEF DESCRIPTION OF THE DRAWINGS

FIG. 3 features a top view of the chest along lines 3—3 of FIG. 2;

FIG. 4 presents a top view of the chest as seen in FIG. 1 with vacuum pumps attached to illustrate the evacuation processes.

FIG. 5 pictures the first conduit and associated ball valve in enlarged fashion with the wrench inserted into the channel;

FIG. 6 depicts a second conduit and check valve, also removed from the chest.

DETAILED DESCRIPTION OF THE PREFERRED EMBODIMENT OF THE INVENTION AND ITS OPERATION

Figure 1:
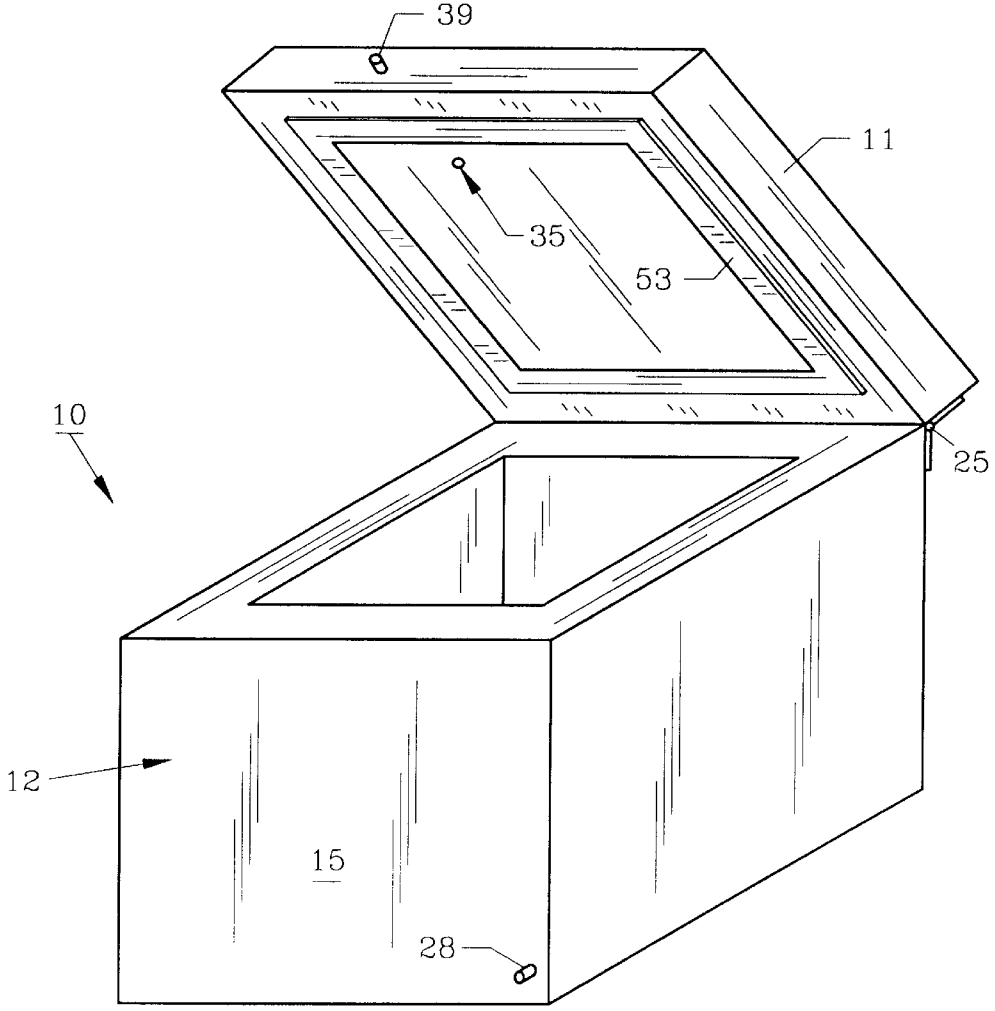
FIG. 1 demonstrates a perspective view of the preferred form of the storage chest of the invention with the cover raised.
Figure 7:
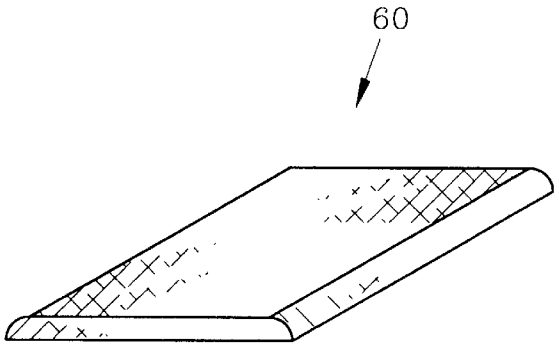
FIG. 7 shows a conventional heating or cooling device as used in the chest.
Figure 2:
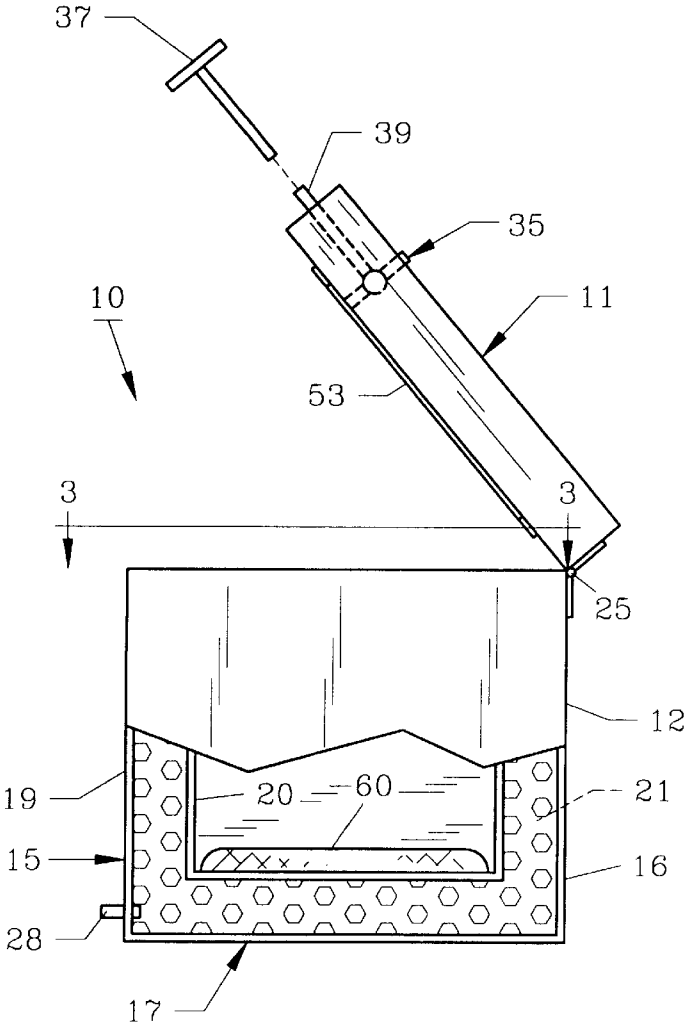
FIG. 2 illustrates a cutaway side view of the chest as shown in FIG. 1 to better show its construction.

For a better understanding of the invention and its method of operation, turning now to the drawings, FIG. 1 shows the preferred form of the invention as insulated chest 10, opened for placement of food or other perishable materials therein. As seen, insulated chest 10 includes a hinged cover 11 and a container 12 formed by hollow side walls 13, 14, front wall 15, rear wall 16 and hollow bottom 17, as seen in FIGS. 2 and 3. Walls 13, 14, 15, 16, bottom 17 and cover 11 are manufactured by sandwiching, in the preferred embodiment, a rigid polyurethane open cell foam material 21, as is conventional in the industry, of approximately 6 cm thickness between two layers 19, 20 of ABS plastic, each layer of approximately 0.5 cm thick for a total wall thickness of approximately 7 cm (FIG. 2). First conduit 35 is shown in FIG. 1 in cover 11, as will be explained in more detail below.

In FIG. 2 outside wall 19 is shown along with inside wall 20 with polymeric foam material 21 therebetween. The same construction is used on all four sides, bottom 17 and cover 11 of chest 10. A piano-type hinge 25, as shown in FIG. 2, allows cover 11 to be easily raised and lowered as needed. During manufacture, to increase the insulative properties of container 12, second conduit 28 is positioned through wall 19 into insulation 21. Insulation 21 has the structural integrity to withstand compressive forces when a vacuum is drawn through conduit 28. Second conduit 28 includes check valve 29, shown schematically in FIG. 6, which allows pump 30 (FIG. 4) to apply vacuum pressure thereto. Once pump 30 has drawn a sufficient vacuum of approximately 75–100 mm of mercury (Hg), pump 30 is disconnected and check valve 29 prevents further air flow. This is part of the manufacturing procedure and is not required by the user. This hollow construction means that hollow bottom 17 has a hollow portion continuous with the hollow portions of side walls 13. This effectively forms a cup-like hollow portion within the exterior walls of chest 10.

Chest 10, as shown in FIG. 2, also includes first conduit 35 which passes through cover 11, and has associated therewith ball valve 36. First conduit 35 is shown removed from cover 11 in FIG. 5. Ball valve 36 can be easily turned manually by the use of wrench 37 which is inserted through perpendicular channel 39 of ball valve 36. Channel 39 is attached to ball valve 36 as shown.

As indicated in FIG. 5, with wrench 37 positioned in conduit 39 of ball valve 36, opening 41 can be rotated from a horizontal position as shown in FIG. 5, to a vertical position, into alignment with conduit 35 to allow fluid passage therethrough. With opening 41 so aligned, vacuum pump 50, as shown in FIG. 4, can then be used to evacuate container 12.

The preferred method of preparing chest 10 for use consists of selecting a conventional thermal element, such as thermal device 60 which is sized to fit along the inside bottom of container 12 as shown in FIG. 2. Thermal device 60 is properly energized (heated or cooled) as desired. For example, if ice-cream is to be placed within container 12, thermal device 60 is placed in a conventional freezer and the temperature lowered a desired amount. Thermal device 60 can be any of the conventional heating and cooling devices as are standard in the marketplace. With thermal device 60 cooled to the desired temperature, it is then placed within container 12 and, for example, ice-cream containers (not shown) are then stacked on top of thermal device 60. Cover 11, having resilient gasket 53, is then closed and vacuum pump 50 is attached to first conduit 35 after ball valve 36 is rotated by wrench 37 to an open position from the closed position. Vacuum pump 50 is then activated and the interior of container 12 is depressurized to approximately 180–250 mm of Hg. Next, wrench 37 is inserted into channel 39 and ball valve 36 is rotated to a closed position as shown in FIG. 5 which prevents air passage through conduit 35. Pump 50 is then disconnected from conduit 35 and chest 10 is pneumatically sealed ready for transportation. It has been found that chest 10 will maintain a −20° C. temperature for approximately twenty-four hours when closed as described with outside temperatures of approximately 25° C. This temperature-controlled environment will allow the user to store and transport ice-cream or other perishable foods or other products over long distances as may be necessary in the food, medical, or biological trades.

The illustrations and methods so described can be modified and changed by those skilled in the art and the examples and drawings are merely for explanatory purposes and are not intended to limit the scope of the appended claims.

I claim:

1. A chest comprising: hollow side walls, a bottom, said bottom joined to said side walls to form a container, a cover, said cover removably positioned on said container, and a first fluid conduit, said first fluid conduit contained within said cover to allow a gas to flow from said container to thereby create vacuum pressure within with said cover placed thereon, said hollow side walls containing vacuum pressure therein.

2. The chest of claim 1 further comprising a pneumatic valve, said pneumatic valve associated with said first fluid conduit to regulate fluid flow therethrough.

3. The chest of claim 2 wherein said pneumatic valve comprises a ball valve.

4. The chest of claim 1 further comprising a second fluid conduit, said second fluid conduit mounted in said hollow walls.

5. The chest of claim 4 further comprising a second pneumatic valve, said second pneumatic valve associated with said second fluid conduit to regulate fluid flow therethrough.

6. The chest of claim 5 wherein said second pneumatic valve comprises a check valve.

7. The chest of claim 4 wherein said second fluid conduit allows air passage from said hollow side walls to thereby form the vacuum pressure therein.

8. The chest of claim 1 wherein said side walls, bottom and said cover contain insulation.

9. The chest of claim 1 further comprising a resilient gasket, said gasket mounted on said cover to seal said cover against said side walls.

10. The chest of claim 1 wherein said cover is hingedly attached to said container.

11. The chest of claim 1 further comprising a means to control temperature, said temperature control means positioned within said container.

12. The chest of claim 11 wherein said temperature control means comprises a cooling element.

13. The chest of claim 11 wherein said temperature control means comprises a heating element.

14. A chest for storing perishable items comprising: insulated hollow sidewalls, an insulated bottom, said insulated hollow side walls attached to said insulated bottom to form a container, an insulated cover, said insulated cover pivotally attached to said container, a first fluid conduit, said first fluid conduit contained within said insulated cover, a first valve, said first valve associated with said first conduit to regulate fluid flow through said insulated cover and from said container to thereby create vacuum pressure within, and a second fluid conduit, said second fluid conduit contained with said hollow side walls, said second fluid conduit to allow fluid flow from said insulated hollow side walls and insulated bottom to the exterior of said container to thereby create a vacuum within said hollow side walls and bottom.

15. The chest of claim 14 further comprising a second valve, said second valve associated with said second conduit.

16. The chest of claim 15 wherein said second valve comprises a check valve.

17. The chest of claim 14 wherein said insulated side walls comprise rigid foam.

18. The chest of claim 14 wherein said insulated cover defines a wrench channel, said wrench channel in communication with said first valve.

19. The chest of claim 14 further comprising a vacuum pump, said vacuum pump connected to said first conduit.

20. A chest for storing perishable items comprising:

a) insulated sidewalls, said insulated side walls defining a first hollow portion;

b) an insulated bottom, said bottom defining a second hollow portion, said insulated sidewalls attached to said insulated bottom to form a container, said second hollow portion continuous with said first hollow portion;

c) an insulated cover, said insulated cover joined to said container;

d) a first fluid conduit, said first fluid conduit delimited by said insulated cover and in fluid communication with said container;

e) a second fluid conduit, said second fluid conduit delimited by said insulated side walls and in fluid communication with first and second hollow portions; and f) a resilient gasket, said gasket mounted on said cover to seal said cover against said side walls;

wherein said first and second fluid conduits allow gas to be drawn from said container and said hollow portions respectively to thereby form a vacuum.

21. The chest of claim 20 further comprising:

a) a cooling element, said cooling element disposed within said container;

b) a piano hinge, said piano hinge pivotally joining said cover to said container; and c) insulation, said insulation disposed within said hollow side walls.

* * * * *